United States Patent [19]

Okumura et al.

[11] Patent Number: 4,677,264

[45] Date of Patent: Jun. 30, 1987

[54] CONTACT MATERIAL FOR VACUUM CIRCUIT BREAKER

[75] Inventors: Mitsuhiro Okumura, Sagamihara; Eizo Naya, Takarazuka; Mitsuhiro Harima, Sagamihara; Shoji Murakami, Yokohama; Seiichi Miyamoto, Sagamihara, all of Japan

[73] Assignee: Mitsubishi Denki Kabushiki Kaisha, Tokyo, Japan

[21] Appl. No.: 804,616

[22] Filed: Dec. 5, 1985

[30] Foreign Application Priority Data

Dec. 24, 1984 [JP] Japan ..... 59-276041
Dec. 24, 1984 [JP] Japan ..... 59-276042
Dec. 24, 1984 [JP] Japan ..... 59-276043

[51] Int. Cl.[4] ..... H01H 9/30

[52] U.S. Cl. ..... 200/144 B; 200/265; 75/228; 420/428; 420/469

[58] Field of Search ..... 200/144 B, 262, 265, 200/266, 275, 279; 75/228; 420/428, 469, 583, 587, 588; 252/500, 506, 513, 519

[56] References Cited

U.S. PATENT DOCUMENTS

| | | | |
|---|---|---|---|
| 3,379,846 | 4/1968 | Wood et al. | 200/144 B |
| 3,514,559 | 5/1970 | Ranheim | 200/144 B |
| 3,859,087 | 11/1974 | Backstrom | 73/213 |
| 3,948,652 | 4/1976 | Schreiner et al. | 75/170 |
| 3,993,481 | 11/1976 | Schreiner et al. | 75/170 |
| 4,014,688 | 3/1977 | Schreiner et al. | 75/123 B |
| 4,014,689 | 3/1977 | Schreiner et al. | 75/129 |
| 4,147,909 | 4/1979 | Hässler et al. | 200/265 |
| 4,302,514 | 11/1981 | Kato et al. | 428/569 |
| 4,372,783 | 2/1983 | Kato | 75/246 |
| 4,419,551 | 12/1983 | Kato | 200/144 B |
| 4,420,346 | 12/1983 | Belkin et al. | 148/4 |
| 4,424,429 | 1/1984 | Yamanaka et al. | 200/264 |
| 4,537,745 | 8/1985 | Hässler et al. | 420/590 |

FOREIGN PATENT DOCUMENTS

| | | | |
|---|---|---|---|
| 0155322 | 8/1984 | European Pat. Off. . | |
| 586666 | 5/1931 | Fed. Rep. of Germany . | |
| 705358 | 3/1941 | Fed. Rep. of Germany . | |
| 705564 | 5/1941 | Fed. Rep. of Germany . | |
| 2124707 | 5/1971 | Fed. Rep. of Germany . | |
| 2310317 | 9/1974 | Fed. Rep. of Germany . | |
| 2619459 | 1/1977 | Fed. Rep. of Germany . | |
| 3027732 | 12/1981 | Fed. Rep. of Germany . | |
| 3150846 | 3/1983 | Fed. Rep. of Germany . | |
| 3303170 | 2/1984 | Fed. Rep. of Germany . | |
| WO82/01960 | 11/1980 | PCT Int'l Appl . | |
| WO85/03802 | 8/1985 | PCT Int'l Appl . | |
| 517065 | 9/1976 | U.S.S.R. | 200/144 B |

OTHER PUBLICATIONS

DE-Z: Elektrotechnik, 63, H.8, Apr. 1981, S.26-28.
DE-Z: Metall, 38.Jg., H.7, Jul. 1984, S.647-651.
DE-Firmenschrift: Gasarme Werstoffe Für Vakuumschalter DODUCO, Nr. 480.
DE-Buch: Dr. Stöckel u.a.: Expert Verlag: Werkstoffe für Elektrische Kontakte, Grafenau/Württ. 1930, S.118-123.
US-Z: Proceedings of the 12th International Conference on Electric Contact Phenomena 1984, S.349-355.

*Primary Examiner*—Mark O. Budd
*Attorney, Agent, or Firm*—Oblon, Fisher, Spivak, McClelland & Maier

[57] ABSTRACT

The present invention provides a contact material for a vacuum circuit breaker containing therein Copper (Cu) and chromium (Cr) with further addition of at least one kind of boride selected from borides of chromium (Cr), molybdenum (Mo) and tungsten (W). Such contact material possesses remarkable advantages of having large current breaking capability and high voltage withstand capability.

13 Claims, 12 Drawing Figures

CONTACT MATERIAL FOR VACUUM CIRCUIT BREAKER

This invention relates to a contact material for a vacuum circuit breaker which is excellent in large current breaking property and high voltage withstand capability.

The vacuum circuit breaker has various advantages such that it is free from maintenance, does not bring about public pollution, is excellent in its current breaking property, and so forth, hence the extent of its application has become widened very rapidly. With this expansion in its utility, demands for higher voltage withstand property and larger current breaking capability of the vacuum circuit breaker have become increasingly high. On the other hand, the performance of the vacuum circuit breaker depends to a large extent on the element to be determined by the contact material placed within a vacuum container for the vacuum circuit breaker.

For the characteristics of the contact material for the vacuum circuit breaker to satisfy, there may be enumerated: (1) large current breaking capacity; (2) high voltage withstand; (3) small contact resistance; (4) small melt-adhesion; (5) low consumption rate of the contact; (6) small breaking current; (7) good workability; (8) sufficient mechanical strength; and so forth.

In the actual contact material, it is fairly difficult to satisfy all of these characteristics, and general circumstances at the present are such that use is made of a material which meets particularly important characteristic depending on its utilization at the sacrifice of other characteristics to some extent. For instance, the contact material of copper-tungsten alloy as disclosed in unexamined Japanese patent publication No. 78429/1980 is excellent in its voltage withstand capability, although it has a disadvantage such that its current breaking capability is inferior.

On the other hand, the contact material of copper-chromium as disclosed, for example, in unexamined Japanese patent publication No. 71375/1979 has been widely used owing to its excellent current breaking capability, but its voltage withstand capability is inferior to that of the above-mentioned contact material of copper-tungsten.

Besides the above-mentioned contact material for the vacuum circuit breaker, various examples of the contact material used generally in air, oil, and so forth are listed in many technical literatures such as "Powder Metallurgy (Hunmatsu Yakin Gaku)" published by Nikkan Kogyo Shimbun-sha, Japan and so forth. However, the silver-molybdenum type contact material and the copper-molybdenum type contact material as described in, for example, "Powder Metallurgy", pages 229 and 230, when used as the contact for the vacuum circuit breaker, is inferior in its voltage withstand characteristic to the above-mentioned copper-tungsten type contact material, and is also inferior in its current breaking capability to the above-mentioned copper-chromium type contact material, on account of which these contact materials are seldom used at present.

As described in the foregoing, the conventional contact materials for the vacuum circuit breaker have so far been used in taking advantage of various properties they possess. In recent years, however, requirements for capability of the vacuum circuit breaker have become more stringent such that it is durable against larger electric current and higher electric potential with the result that such conventional contact materials tend to be difficult to satisfy the required performance. There has also been a demand for the contact material having more excellent performance against size-reduction in the vacuum circuit breaker.

The present invention has been made with a view to eliminating various points of problem inherent in the conventional contact material as mentioned in the foregoing, and aims at providing the improved contact material for the vacuum circuit breaker excellent in its large current breaking property and higher voltage withstand capability.

The contact material for the vacuum circuit breaker according to the present invention contains therein copper, chromium, and further boride of at least one kind selected from chromium, molybdenum and tungsten.

Various ways of carrying out the present invention are described in detail hereinbelow with reference to the accompanying drawings which illustrate several specific embodiments, in which.

Figure 4:
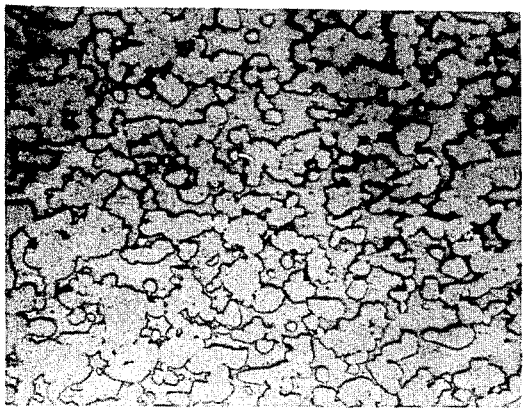
Figure 5:
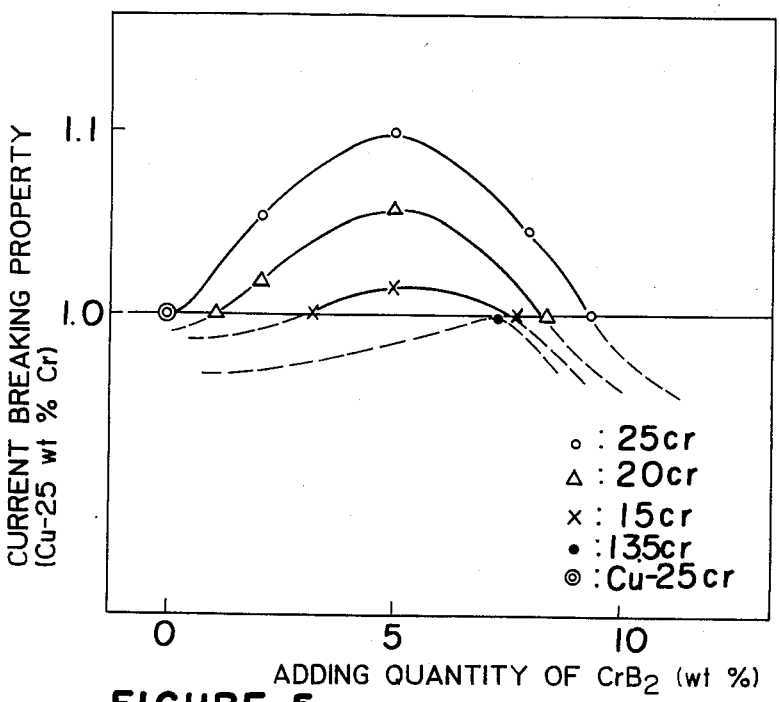
Figure 6:
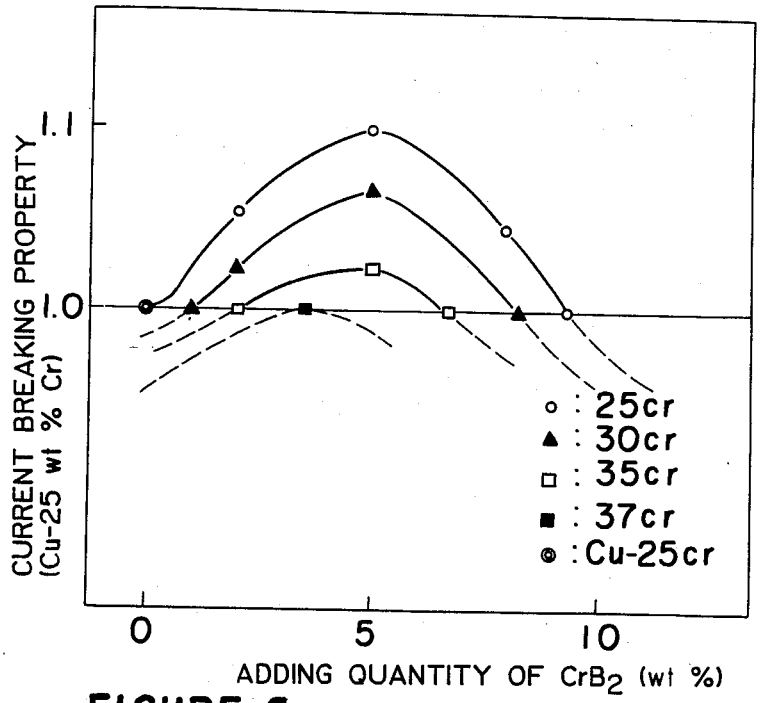
Figure 7:
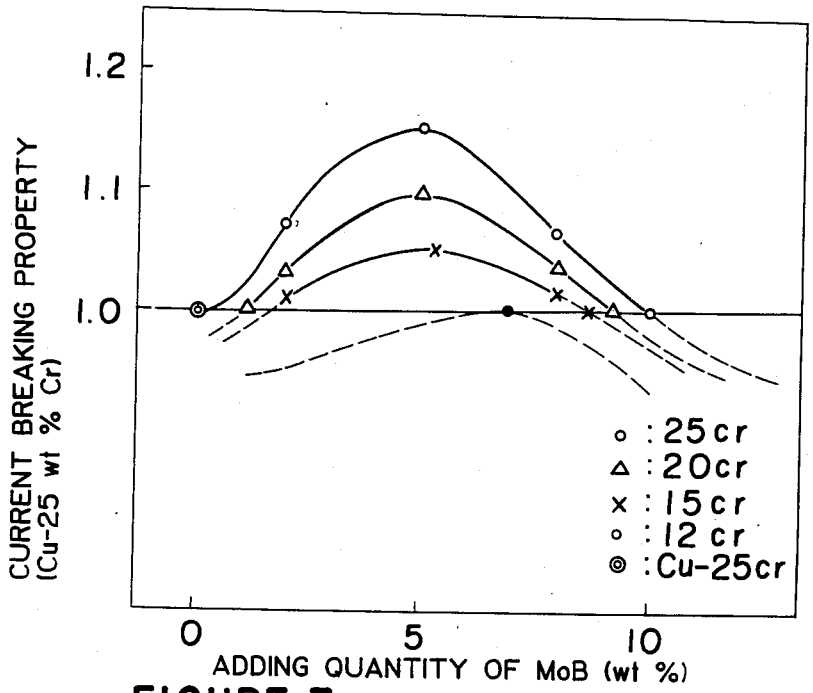
Figure 8:
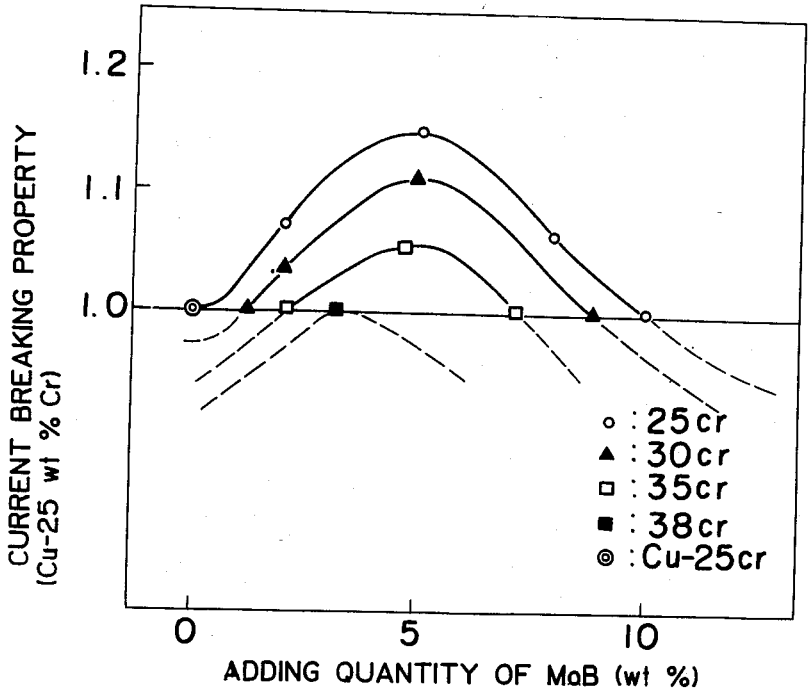
Figure 9:
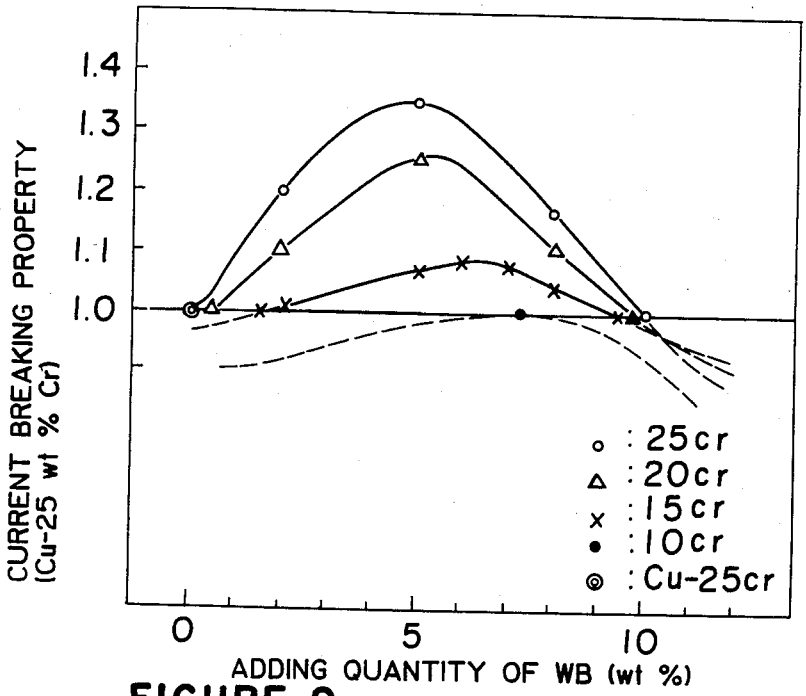
Figure 10:
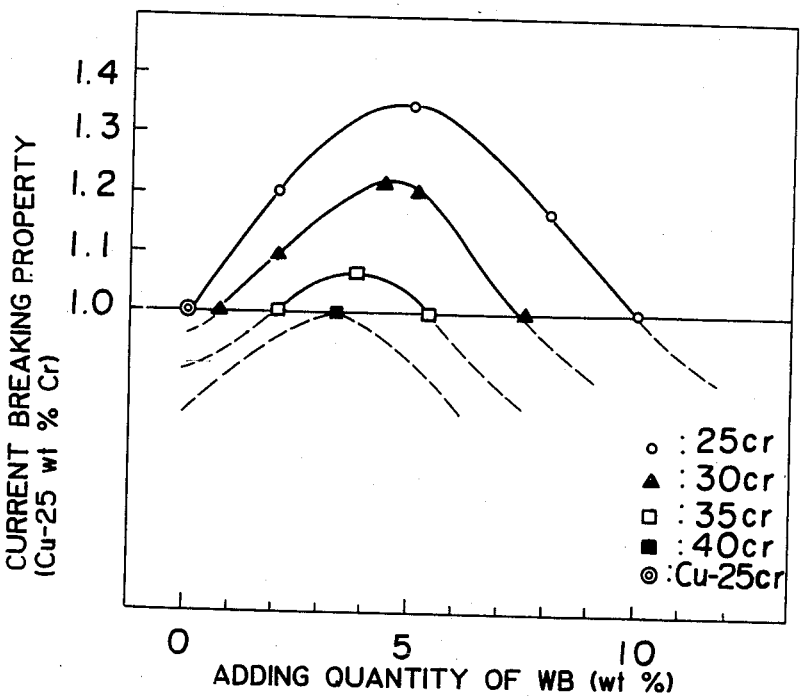
Figure 11:
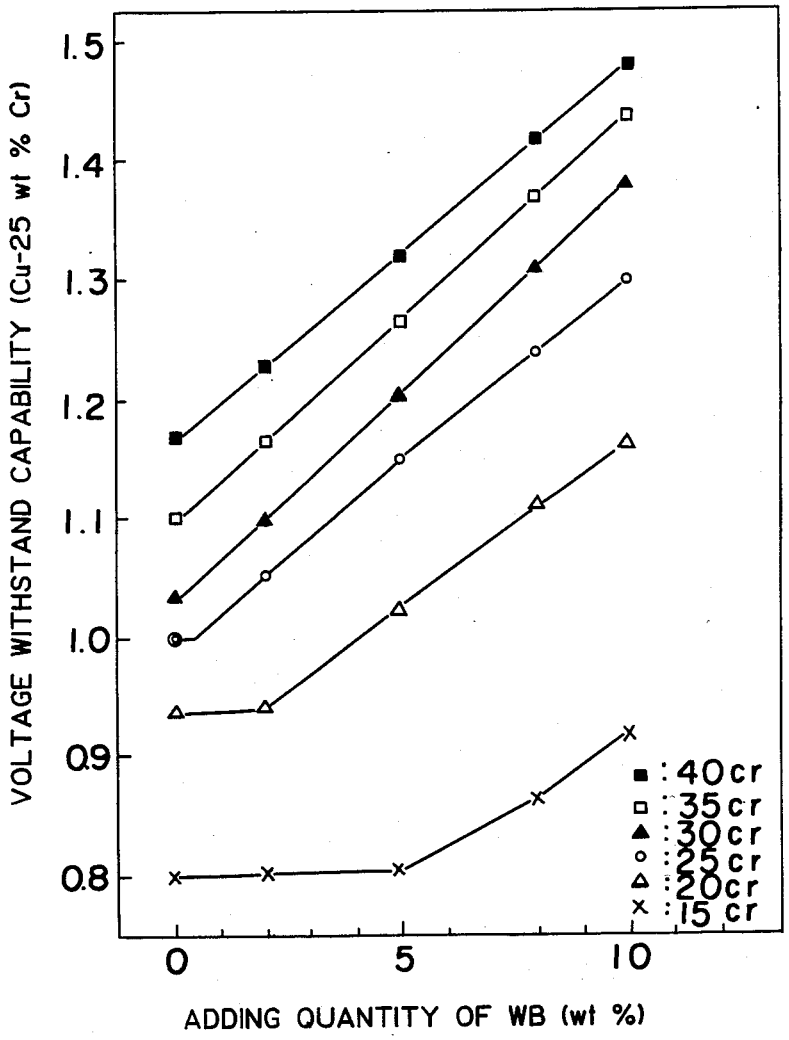
Figure 12:
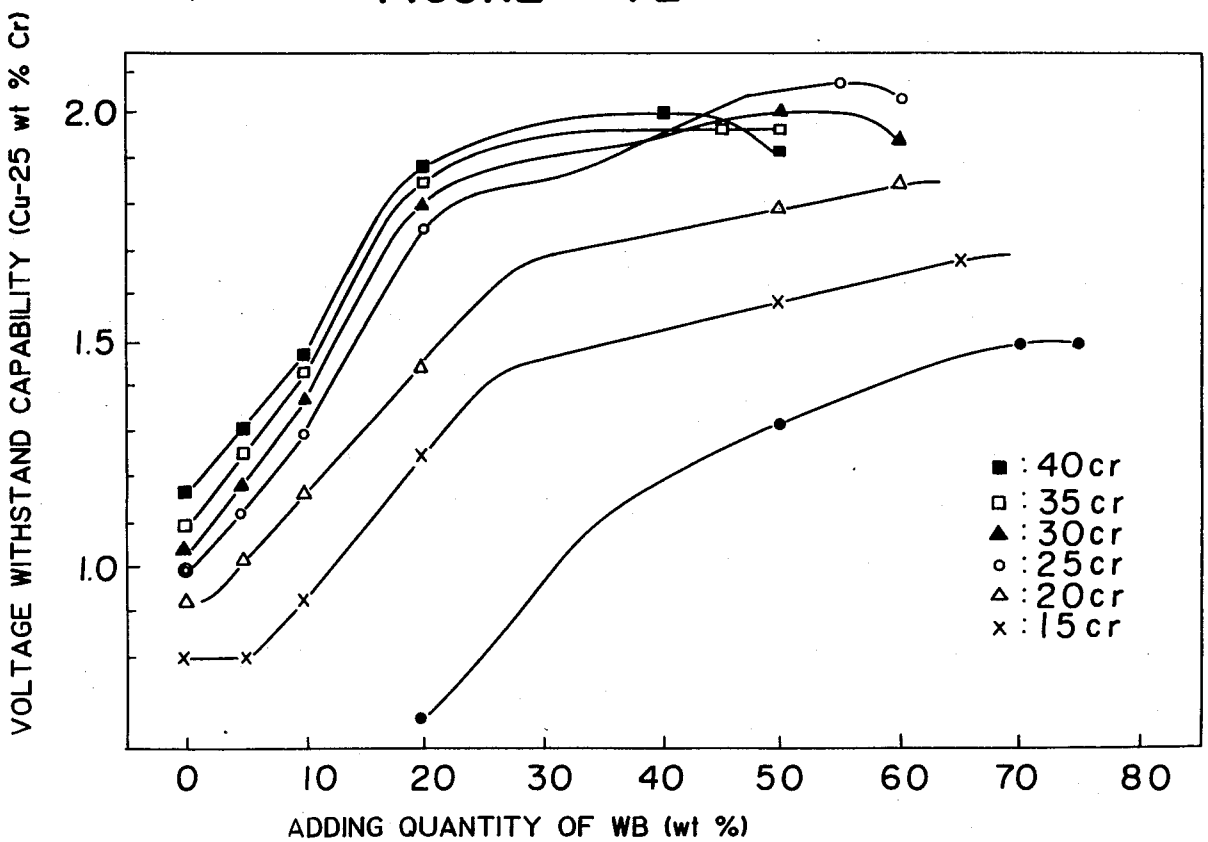

FIG. 4 i a micrograph in the scale of 100 magnification showing a microstructure of the conventional contact material composed of copper (Cu) and 25% by weight of chromium (Cr) produced by the atmospheric sintering method in the hydrogen atmosphere;

FIG. 5 is a graphical representation showing the relationship between the adding quantity of $CrB_2$ and the current breaking capability of the contact material according to the first embodiment of the present invention, wherein the weight ratio of chromium (Cr) is fixed at 13.5, 15, 20 and 25, respectively;

FIG. 6 a graphical representation showing the relationship between the adding quantity of $CrB_2$ and the current breaking capability of the contact material according to the second embodiment of the present invention, wherein the weight ratio of chromium (Cr) is fixed at 25, 30, 35 and 37, respectively;

FIG. 7 is a graphical representation showing the relationship between the adding quantity of MoB and the current breaking capability of the contact material according to the third embodiment of the present invention, wherein the weight ratio of chromium (Cr) is fixed at 12, 15, 20 and 25, respectively;

FIG. 8 is a graphical representation showing the relationship between the adding quantity of MoB and the current breaking capability of the contact material according to the third embodiment of the present invention, wherein the weight ratio of chromium (Cr) is fixed at 25, 30, 35 and 38, respectively;

FIG. 9 is a graphical representation showing the relationship between the adding quantity of WB and the current breaking capability of the contact material according to the third embodiment of the present invention, wherein the weight ratio of chromium (Cr) is fixed at 10, 15, 20 and 25, respectively;

FIG. 10 is a graphical representation showing the relationship between the adding quantity of WB and the current breaking capability of the contact material according to the third embodiment of the present invention, wherein the weight ratio of chromium is fixed at 25, 30, 35 and 40, respectively; and FIGS. 11 and 12 are respectively graphical representations showing the relationship between the adding quantity of WB and the voltage withstand capability of the contact material according to the third embodiment of the present invention, wherein the weight ratio of chromium (Cr) is fixed at 15, 20, 25, 30, 35 and 40, respectively.

In the following, the present invention will be described with reference to one embodiment thereof.

(Production of Contact Material)

(1) First of all, explanations will be given as to the first embodiment of the contact material which contains therein copper (Cu), chromium (Cr) and a boride of chromium.

The contact material was produced in accordance with the powder metallurgy using the three methods of atmospheric sintering (complete powder sintering method), pressurized sintering (hot press method), and infiltration.

Production of the contact material according to the first method of atmospheric sintering was carried out in such a way that chromium powder having a particle size of 70 μm or below, $CrB_2$ powder having a particle size of 40 μm or below, and copper powder having a particle size of 40 μm or below were each weighed at a predetermined ratio, followed by mixing the ingredients for about two hours; subsequently, this mixed powder was filled in a metal mold and subjected to shaping under pressure; thereafter, this pressed-formed body was sintered for about two hours in the hydrogen atmosphere at a temperature immediately below the melting point of copper, thereby obtaining the intended contact material.

Production of the contact material according to the second method of pressurized sintering was carried out in such a way that chromium powder having a particle size of 70 μm or below, $CrB_2$ powder having a particle size of 40 μm or below, and copper powder having a particle size of 40 μm or below were each weighed at a predetermined ratio, followed by mixing the ingredients for about two hours; subsequently, this mixed powder was filled in a carbon dice which was then placed in a hot press device and subjected to heating for about two hours at a temperature of from 1,000° C. to 1,050° C. in the vacuum, during which a pressure of from 100 to 300 kg/cm$^2$, for example, 200 kg/cm$^2$, was applied to the mixed powder by means of the hot press device, thereby obtaining a mass of the contact material. It was also carried out to obtain a contact material by filling the above-mentioned mixed powder in a metal mold to subject it to shaping under pressure, and then effecting the hot press forming on this shaped body by means of the hot press device. In addition, for the sake of confirmation, there was conducted production of the contact material by means of a hot hydrostatic press device (HIP) as one of various expedients for carrying out the pressurized sintering method. The conditions for the manufacture were such that a mixed powder in a predetermined mixing ratio was shaped in a metal mold, and then the shaped body was sealed in a metal container to treat the same for about two hours at a temperature below the melting point of copper and under a pressure of from 1 to 2 tons/cm$^2$, thereby obtaining the contact material.

Production of the contact material according to the third method of infiltration was carried out in such a way that chromium powder having a particle size of 70 μm or below, $CrB_2$ powder having a particle size of 40 μm or below, and copper powder having a particle size of 40 μm or below were each weighed at a predetermined ratio, followed by mixing the ingredients for about two hours (the quantity of copper powder to be added here is small, which is about 5% by weight or so with respect to the total quantity of chromium powder and $CrB_2$ powder); subsequently, this mixed powder was filled in a metal mold and subjected to shaping under pressure; thereafter, this shaped body was sintered for about two hours at a temperature of from 900° C. to 1,050° C. to thereby obtain a virtual sintered body; and, after this, a mass of oxygen-free copper was placed on the virtual sintered body, which was held for about one hour in the hydrogen atmosphere at a temperature above the melting point of copper to thereby obtain the contact material with the oxygen-free copper having been impregnated into the virtual sintened body. While it is possible to regulate copper in the contact material in a desired quantity by varying the shaping pressure to be applied to the mixed powder, it is necessary that the volume of copper in the contact material should be smaller by ½ or below than the whole contact material in order to impregnate the shaped body containing voids therein with copper, after it was obtained, which is the characteristic feature of this production method.

Figure 1:
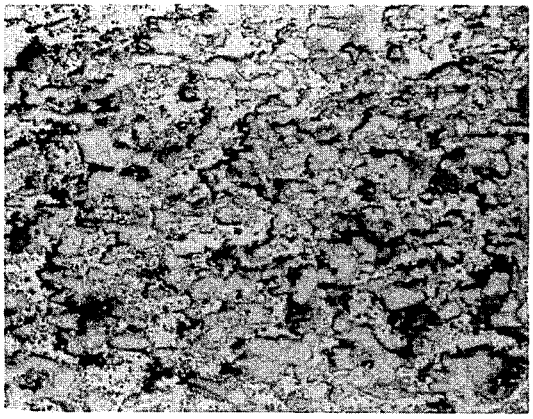
FIG. 1 is a micrograph in the scale of 100 magnification showing a microstructure of the contact material composed of copper (Cu), 25% by weight of chromium (Cr), and 5% by weight of $CrB_2$ according to the first embodiment of the present invention.

FIG. 1 of the accompanying drawing is a micrograph in the scale of 100 magnification showing a microstructure of the contact material composed of an alloy of Cu-Cr-$CrB_2$ according to the first embodiment of the present invention. This Cu-Cr-$CrB_2$ alloy contact material was obtained by first weighing chromium powder having a particle size of 70 μm or below, $CrB_2$ powder having a particle size of 40 μm or below, and copper powder having a particle size of 40 μm or below at their respective weight ratio of 25:5:70, carrying out mixing of the ingredients for two hours, then filling the mixed powder in a metal mold having an inner diameter of ϕ30, subjecting the mixed powder to shaping under pressure of 3 tons/cm$^2$, thereafter charging this shaped body in a carbon dice having an inner diameter of ϕ30.5 to be subjected to heating for two hours in the vacuum at a temperature of from 1,000° C. to 1,050° C., during which a pressure of 200 kg/cm$^2$ was applied to the shaped body. It will be seen from FIG. 1 that Cr and $CrB_2$ are uniformly and minutely distributed in the copper.

FIG. 4 is a micrograph in the scale of 100 magnification showing a microstructure of a conventional Cu-Cr alloy contact material, for the sake of comparison. This Cu-Cr alloy contact material was obtained by first weighing chromium powder having a particle size of 70 μm or below and copper powder having a particle size of 40 μm or below at their respective weight ratio of 25:75, then carrying out mixing of the ingredients for two hours, subsequently filling this mixed powder in a metal mold having an inner diameter of ϕ30 to subject the same to shaping under pressure of 3 tons/cm$^2$, and thereafter heating this shaped body in the hydrogen atmosphere for two hours at a temperature immediately below the melting point of copper (i.e., 1,050° C. to 1,080° C.).

(2) In the following, explanations will be given as to the second embodiment of the contact material which contains therein copper, chromium, and a boride of molybdenum.

The contact material was produced in accordance with the powder metallurgy using the two methods of atmospheric sintering and pressurized sintering.

Production of the contact material according to the first method of atmospheric sintering was carried out in such a manner that chromium powder having a partrcle size of 70 μm or below, MoB powder having a particle size of 40 μm or below, and copper powder having a particle size of 40 μm or below were each weighed at a predetermined ratio, followed by mixing the ingredients for about two hours; subsequently, this mixed powder was filled in a metal mold having its inner diameter of ϕ30 and subjected to shaping under pressure; thereafter, this shaped body was sintered for about two hours in the hydrogen atmosphere at a temperature immediately below the melting point of copper, thereby obtaining the intended contact material.

Production of the contact material according to the second method of pressurized sintering was carried out in such a manner that chromium powder having a particle size of 70 μm or below, MoB powder having a particle size of 40 μm or below, and copper powder having a particle size of 40 μm or below were each weighed at a predetermined ratio, followed by mixing the ingredients for about two hours, subsequently this mixed powder was filled in a carbon dice having its inner diameter of ϕ30.5 and heated by a hot press device for two hours in the vacuum at a temperature of from 1,000° C. to 1,050° C., during which a pressure of from 100 to 300 kg/cm$^2$ (200 kg/cm$^2$, as one example) was applied, thereby obtaining the contact material in mass. It was also carried out that the above-mentioned mixed powder was filled in a metal mold having its inner diameter of ϕ30 to be subjected to shaping under pressure, after which the shaped body was subjected to the hot press forming by means of a hot press device to obtain the contact material, or that the shaped body of the above-mentioned mixed powder obtained by cold press was sealed in vacuum stainless steel container and heated in the argon atmosphere for two hours at a temperature immediately below the melting point of copper, during which a hydrostatic pressure of 1 to 2 tons/cm$^2$ was applied thereto.

By the way, even in the first method of atmospheric sintering, there could be obtained the contact material having a theoretical density of 95% or above; however, according to the second method of pressurized sintering, there could be obtained the contact material with its theoretical density reaching substantially 99% or above, and the electrical conductivity and hardness of the contact material obtained by the pressurized sintering method having also been found slightly superior to the one obtained by the atmospheric sintering method.

Figure 2:
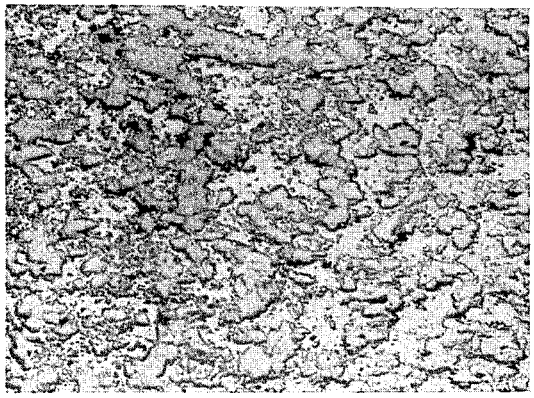
FIG. 2 is a micrograph in the scale of 100 magnification showing a microstructure of the contact material composed of copper (Cu), 25% by weight of chromium (Cr), and 5% by weight of MoB according to the second embodiment of the present invention.

FIG. 2 is a micrograph in the scale of 100 magnification showing a microstructure of the contact material composed of an alloy of Cu-Cr-MoB according to the second embodiment of the present invention. This Cu-Cr-MoB alloy contact material was obtained by first weighing chromium powder, MoB powder and copper powder at their respective weight ratio of 25:5:70, mixed the ingredients for two hours, then press-forming the mixed powder under a pressure of 3 tons/cm$^2$, thereafter charging this shaped body in a carbon dice having its inner diameter of ϕ30.5, followed by heating the same in the vacuum for two hours at a temperature immediately below the melting point of copper, during which a pressure of 200 kg/cm$^2$ was applied to the shaped body, the resulted Cu-Cr-MoB alloy contact material having a size of ϕ30.5×10t. It will be seen from FIG. 2 that Cr and MoB are uniformly and minutely distributed in the copper.

(3) In the following, explanations will be given as to the third embodiment of the contact material which contains therein copper, chromium, and a boride of tungsten.

The contact material was produced in accordance with the powder metallurgy using the three methods of atmospheric sintering, pressurized sintering, and infiltration.

Production of the contact material according to the first method of atmospheric sintering was carried out in such a manner that chromium powder having a particle size of 70 μm or below, WB powder having a particle size of 40 μm or below, and copper powder having a particle size of 40 μm or below were each weighed at a predetemined ratio, followed by mixing the ingredients for two hours; subsequently, this mixed powder was filled in a metal mold having a predetermined configuration and subjected to press-forming; thereafter, this shaped body was sintered for two hours in the hydrogen atmosphere at a temperature immediately below the melting point of copper, thereby obtaining the intended contact material.

Production of the contact material according to the second method of pressurized sintering was carried out in such a manner that chromium powder having a particle size of 70 μm or below, WB powder having a particle size of 40 μm or below, and copper powder having a particle size of 40 μm or below were each weighed at a predetermined ratio, followed by mixing the ingredients for two hours, subsequently, this mixed powder was filled in a carbon dice and heated in the vacuum for two hours at a temperature immediately below the melting point of copper, during which a pressure of from 100 to 300 kg/cm$^2$ (200 kg/cm$^2$ in this example) was imparted, thereby obtaining a mass of the contact material.

Production of the contact material according to the third method of infiltration was carried out in such a manner that chromium powder having a particle size of 70 μm or below, WB powder having a particle size of 40 μm or below, and copper powder having a particle size of 40 μm or below were each weighed at a predetermined ratio, followed by mixing the ingredients for two hours (the copper powder to be added here is small in its quantity, which is about 5% by weight or so with respect to the total quantity of chromium powder and WB powder); subsequently, this mixed powder was filled in a metal mold having a predetermined configuration and subjected to shaping under pressure; thereafter, this shaped body was sintered in the vacuum for two hours at a temperature immediately below the melting point of copper to thereby obtain a virtual sintered body; and, after this, a mass of oxygen-free copper was placed on the virtual sintered body, which was held for one hour in the hydrogen atmosphere at a temperature above the melting point of copper, whereby the contact material with the oxygen-free copper having been impregnated into the virtual sintered body was obtained. While it is possible to regulate copper in the contact material in a desired quantity by varying the shaping pressure to be applied to the mixed powder, it is necessary that the volume of copper in the contact material should be smaller by ½ or below than the total contact material in order to impregnate the shaped body containing therein voids with copper, after it was obtained, which is the characteristic feature of this production method.

Figure 3:
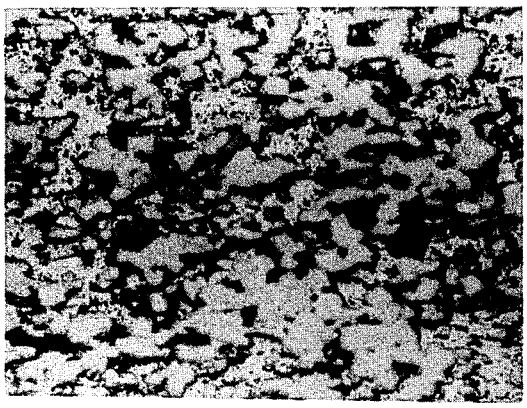
FIG. 3 is a micrograph in the scale of 100 magnification showing a microstructure of the contact material composed of copper (Cu), 25% by weight of chromium (Cr), and 5% by weight of WB according to the third embodiment of the present invention.

FIG. 3 is a micrograph in the scale of 100 magnification showing a microstructure of a conventional Cu-Cr-WB alloy contact material according to the third embodiment of the present invention. This Cu-Cr-WB alloy contact material was obtained by first weighing chromium powder having a particle size of 70 μm or below, WB powder having a particle size of 40 μm or below, and copper powder having a particle size of 40 μm or below at their respective weight ratio of 25:5:70, and then subjecting the mixed powder to the first method of atmospheric sintering. Incidentally, the sintering was conducted in the high purity hydrogen atmosphere and at a temperature in a range of from 1,050° C. to 1,080° C. It will be seen from FIG. 3 that the alloy indicates uniform and minute distribution of Cr and WB in the copper.

(Experiments on Properties of Contact Material)

The contact materials according to the embodiments of the present invention as produced by the afore-described various methods in the powder metallurgy were machined into electrodes, each having 20 mm in diameter. Each of the electrodes was assembled into a vacuum circuit breaker to measure its electrical properties.

FIGS. 5 and 6 both indicate the current breaking property of the contact material according to the first embodiment of the present invention, in which the current breaking property of the contact material according to the present invention is expressed in terms of the current breaking property of the conventional Cu-25% wt. Cr alloy contact material, when it is set at "1". This current breaking property was evaluated from the result of the composite current breaking tests, wherein the direct current component and the arc time were diversely changed. At first, the test was conducted on the conventional Cu-25% wt. Cr alloy contact material to find a reference value. In the next place, the test was conducted on the contact material of the present invention, starting from the quality level equal to that of the conventional contact material, to thereby measure the current breaking property thereof. The broken lines in FIGS. 5 and 6 indicate those data which are lower in range than the data of the conventional contact material, the details of which are yet to be clarified.

FIG. 5 indicates a relationship between the adding quantity of $CrB_2$ and the current breaking property, wherein the content of Cr in the alloy (wt. %) is fixed at 13.5, 15, 20 and 25, respectively. When the Cr content is 13.5% by weight or above, there is seen an improvement in the current breaking property owing to addition of $CrB_2$ That is to say, when the Cr content is 25% by weight and the $CrB_2$ content is 5% by weight or so, there can be recognized increase in the current breaking capability of about 1.1 times or so in comparison with that of the conventional Cu-25% wt. Cr alloy contact material; however, with the $CrB_2$ content of 0.2% by weight or below, no effect can be seen at all. On the other hand, when the $CrB_2$ content exceeds 9.3% by weight, there takes place decrease in the current breaking capability. Therefore, the peak value of the effect of the current breaking property due to addition of $CrB_2$ depends on the Cr content. By the way, it should be noted that the optimum Cr and $CrB_2$ contents may be selected in accordance with use of the contact material.

FIG. 6 indicates a relationship between the adding quantity of $CrB_2$ and the current breaking capability, wherein the Cr content in the alloy (wt. %) is fixed at 25, 30, 35 and 37, respectively. When the Cr content is 37% by weight or below, there can be seen an improvement in the current breaking capability owing to addition of $CrB_2$Accordingly, for its use wherein much emphasis is placed on the current breaking property of the contact material, it should be preferable that the Cr content be in a range of from 13.5 to 37% by weight, and the $CrB_2$ content be in a range of from 0.2 to 9.3% by weight.

However, in so far as the Cr content is not zero, there can be obtained the contact material having the excellent voltage withstand capability by various combination of Cr and $CrB_2$. For example, when the Cr content is 25% by weight and the $CrB_2$ content is 5% by weight, the voltage withstand capability increases by 1.5 times or so as high as that of the conventional Cu-25% wt. Cr alloy contact material. As for the voltage withstand capability, there is a range, in which the required capability can be obtained by addition of a large quantity of $CrB_2$ when the Cr content is small, and by addition of a small quantity of $CrB_2$ when the Cr content is large. It should however be noted that, when the total quantity of Cr and $CrB_2$ exceeds 80%, there will no longer be seen more increased effect of the voltage withstand, but there will rather be a case of its being decreased. This has something to do with the manner of production of such alloy material, so that, taking into consideration of this problem in manufacture, the upper limit figure of manufacturing the possible contact material free from any defect would be 80% or so of the total content of Cr and $CrB_2$Furthermore, when the Cr and $CrB_2$ contents increase, the workability of the material lowers, in association with which various factors to deteriorate the voltage withstand capability such as occurrence of small projections on the surface of the contact, and others will also increase.

Incidentally, FIGS. 5 and 6 indicate the data of the samples obtained by the hot press method which is one of the second production method, i.e., the pressurized sintering method. Note should, however, be taken that substantially same results were obtained with those samples obtained by the atmospheric sintering method.

Moreover, it has been verified that even a low shearing contact material for the vacuum circuit breaker produced by adding to the above-mentioned alloy 20% by weight or less of at least one kind of substance selected from low melting point metals such as Bi, Te, Sb, Tl, Pb, Se, Ce and Ca; alloys of these low melting point metals; and intermetallic compounds thereof has an effect of increasing the current breaking capability and the voltage withstand capability as is the case with the foregoing examples, though this is not shown in the drawing.

Further, in the above-described examples, copper, chromium and boride of chromium are considered to be distributed in the form of a simple metal, alloy of two or three of them, intermetallic compound of three or two of them, or a composite body thereof.

FIGS. 7 and 8 both indicate the current breaking capability of the contact material according to the second embodiment of the present invention.

FIG. 7 indicates a relationship between the adding quantity of MoB and the current breaking capability, when the Cr content in the alloy (wt. %) is fixed at 12, 15, 20 and 25, respectively. When the Cr content is 12% by weight or more, there can be seen an improvement in the current breaking capability owing to addition of MoB. When the Cr content is 25% by weight and the MoB content is 5% by weight or so, the current breaking capability increases by about 1.15 times as high as that of the conventional Cu-25% wt. Cr alloy contact material. However, no increased effect can be seen at all with the MoB content not reaching 0.2% by weight. On the other hand, when the MoB content exceeds 10% by weight, the current breaking capability lowers inevitably.

FIG. 8 shows a relationship between the adding quantity of MoB and the current breaking capability, when the Cr content in the alloy (wt. %) is fixed at 25, 30, 35 and 38, respectively. When the Cr content is 38% by weight or less, there can be seen an improvement in the current breaking capability owing to addition of MoB. Accordingly, for the contact material for the vacuum circuit breaker, a preferred range of the Cr content may be from 12 to 38% by weight, and that of the MoB content may be from 0.2 to 10% by weight. It has also been verified that, by addition of MoB, the voltage withstand capability tends to improve.

Further, in the above-described examples, copper, molybdenum, and boride or chromium are considered to be distributed in the form of a simple metal, alloy of two or three of them, intermetallic compound of three or two of them, or a composite body thereof.

In the foregoing description, MoB is used as an example of boride of molybdenum. It should however be noted that the same effect could be derived from use of other borides of molybdenum such as $MoB_2$, $Mo_2B$ and so forth. From the experimental results, however, the current breaking capability improved most effectively when the alloy contained therein at least one of MoB and $MoB_2$ as the boride of molybdenum.

Moreover, it has been verified that even a low shearing contact material for the vacuum circuit breaker produced by adding to the above-mentioned alloy 10% by weight or less of at least one kind of substance selected from low melting point metals such as Bi, Te, Sb, Tl, Pb, Se, Ce and Ca; alloys of these low melting point metals; intermetallic compounds thereof; and oxides thereof has an effect of increasing the current breaking capability and the voltage withstand capability, though this is not shown in the drawing. When 10% by weight or more of at least one kind of these low melting point metals, their alloys, their intermetallic compounds, and their oxides is added to the material, the current breaking capability lowered considerably. Also, when the low melting point metal is Ce or Ca, there was observed a slight fall in the capability.

FIGS. 9 and 10 indicate both the current breaking capability of the alloy according to the third embodiment of the present invention, in which the current breaking capability of the contact material according to the present invention is expressed in terms of the current breaking capability of the conventional Cu-25% wt. Cr alloy contact material, when it is set at "1". FIG. 9 indicates variations in the current breaking capability owing to change in the adding quantity of WB, when the Cr content in the alloy (wt. %) is fixed at 10, 15, 20 and 25, respectively. FIG. 10 indicates variations in the current breaking capability owing to change in the adding quantity of WB, when the Cr content in the alloy (wt. %) is fixed at 25, 30, 35 and 40, respectively. As seen from FIGS. 9 and 10, there is a region, in which the current breaking capability of the contact material according to the present invention exceeds that of the conventional Cr-25% wt. Cr alloy contact material by addition of WB at a predetermined rate with respect to the Cr content. From this, it will be seen that the contact material for the circuit breaker according to the present invention is suitable for use in a large current circuit breaker. Depending, however, on the Cr content, there is a case of no improvement being attained by addition of WB. According to the experiments done in this example, a very effective result can be obtained with the Cr content in the range of from 10 to 40% by weight, and, more particularly, the Cr content of 25% by weight is the most excellent. Further, as to the addition of WB, there is the optimum range; that is to say, a range of from 0.2 to 10% by weight of WB is very effective. More specifically, the contact material alloy containing therein 25% by weight of Cr and 5% by weight of WB is the most excellent, exhibiting improvement in the current breaking capability which is 1.35 times as high as that of the conventional alloy. By the way, it should be noted that, according to the experiments in this example, no concrete ratio of the ingredients could be shown for the alloy having its current breaking capability inferior to that of the conventional alloy, because very detailed measurements were conducted on the alloy having its current breaking capability superior to that of the conventional alloy, hence such unknown data are shown with broken lines in the drawing. Furthermore, since there could be observed no substantial differences between the atmospheric sintering method and the pressurized sintering method in the production of the alloy according to the examples of the present invention and the conventional alloy, as shown in FIGS. 9 and 10, only the data for the alloys obtained by the atmospheric sintering method (perfect powder sintering method) are shown in the drawing.

FIG. 11 shows a relationship between the adding quantity of WB and the voltage withstand capability of the contact material when the Cr content in the alloy (wt. %) is fixed at 15, 20, 25, 30, 35 and 40, respectively. The WB content is in a range of from 0 to 10% by weight. The voltage withstand capability of this contact material is shown in terms of a ratio when the voltage withstand capability of the conventional Cu-25% wt. Cr alloy contact material is set at "1". As seen from FIG. 11, there is a remarkable improvement in the voltage withstand capability of the contact material due to addition of WB, which proves that the alloy of the present invention is highly excellent as the contact material for the high voltage purpose.

FIG. 12 indicates a relationship between the adding quantity of WB and the voltage withstand capability of the contact material when the Cr content in the alloy (wt. %) is fixed at 10, 15, 20, 25, 30, 35 and 40 respectively. The WB content is in a range of from 0 to 75% by weight. From FIG. 12, it is also seen that the voltage withstand capability of each alloy remarkably improves by the addition of WB. Particularly remarkable improvement is seen with the adding quantity of WB in the range upto and including 20% by weight for the alloys, each having the fixed Cr content. However, exceeding this adding quantity of 20% by weight, the improvement in the voltage withstand capability slows down in comparison with increase in the adding quantity of WB, and, when the total quantity of Cr and WB reaches 80% by weight or so, the voltage withstand capability stops its improvement, or, in some case, it will rather lower. The reason for this is that, on the one hand, WB has its effect such that it is minutely dispersed in the alloy to contribute to reinforcement of the copper base and the chromium particles, thereby suppressing the partial melt-adhesion phenomenon of the contact surface, preventing protrusions which cause lowering in the voltage withstand capability from being produced, and so forth, hence it remarkably improves the voltage withstand capability of the alloy; on the other hand, however, when the contents of Cr and WB increase more than required, it becomes difficult to manufacture the alloy free from defect and having uniform structure in its manufacture, and such alloy has poor workability, on account of which those factors liable to decrease the voltage withstand capability, such as protrusions on the contact surface and so on, would rather increase. From the experimental results, it is considered desirable that the total contents of Cr and WB in the alloy be 80% by weight or less. Incidentally, FIGS. 11 and 12 indicate the measured values of the alloy obtained by the infiltration method, in which the total content of Cr and WB is 50% by weight or more. For the alloy having the total content of Cr and WB of 50% by weight or less, measured values of the alloy obtained by the perfect powder sintering method in the hydrogen atmosphere are used. While the alloy having the total contents of Cr and WB of 50% by weight or more may also be obtained by the perfect powder sintering method or the hot press method, the alloy obtained by the infiltration method has a slightly improved capability; therefore the measured values of the alloy having the above-mentioned alloy composition and produced by the two kinds of production method are shown in the drawing.

By the way, it has been verified that even the low shearing contact material for the vacuum circuit breaker obtained by adding to the above-mentioned alloy 20% by weight or less of at least one kind of substance selected from low melting point metals such as Bi, Te, Sb, Tl, Pb, Se, Ce and Ca; alloys of these low melting point metals; and intermetallic compounds thereof has the effect of increasing the current breaking capability and the voltage withstand capability same as the afore-described examples.

It is also considered that, in the above-described example, copper, chromium, and boride of tungsten are distributed in the form of a simple metal, or an alloy of three or two of them, or an intermetallic compound of three or two of them, or a composite body thereof.

Furthermore, in the above-described example, explanations have been given with regard to WB as an example of boride of tungsten, although the same effect could be obtained with use of other borides of tungsten such as, for example, $W_2B_5$, $WB_2$, $W_2B$, $WB_6$, and others. From the experimental results, however, the optimum effect could be obtained with the alloy containing therein at least one kind of WB and $W_2B_5$ as the boride of tungsten.

We claim:

1. A contact material for a vacuum circuit breaker comprising:

copper, chromium and at least one kind of boride selected from the group consisting of (i) chromium boride, wherein said chromium boride is present in a range of from 0.2 to 9.3% by weight, (ii) molybdenum boride, wherein said molybdenum boride is present in a range of from 0.2 to 10% by weight, and (iii) tungsten boride, wherein said tungsten boride is present in a range of from 0.2 to 10% by weight.

2. A contact material for a vacuum circuit breaker according to claim 1, characterized in that said boride is boride of chromium.

3. A contact material for a vacuum circuit breaker according to claim 2, characterized in that the total content of chromium and boride of chromium is 80% by weight or less.

4. A contact material for a vacuum circuit breaker according to claim 2, characterized in that the chromium content is in a range of from 13.5 to 37% by weight.

5. A contact material for a vacuum circuit breaker according to claim 2, characterized in that boride of chromium is $CrB_2$.

6. A contact material for a vacuum circuit breaker according to claim 1, characterized in that said boride is boride of molybdenum.

7. A contact material for a vacuum circuit breaker according to claim 6, characterized in that it contains copper, and, as other components, 12 to 38% by weight of chromium and 0.2 to 10% by weight of boride of molybdenum.

8. A contact material for a vacuum circuit breaker according to claim 6, characterized in that said boride of molybdenum is at least one selected from MoB and $MoB_2$.

9. A contact material for a vacuum circuit breaker according to claim 6, characterized in that it contains 10% by weight or less of at least one kind of substance selected from low melting point metals such as bismuth, tellurium, antimony, tallium, lead, selenium, cerium, and calcium; alloys of these low melting point metals; intermetallic compounds thereof; and oxides thereof.

10. A contact material for a vacuum circuit breaker according to claim 1, characterized in that said boride is boride of tungsten.

11. A contact material for a vacuum circuit breaker according to claim 10, characterized in that the total content of chromium and boride of tungsten is 80% by weight or less.

12. A contact material for a vacuum circuit breaker according to claim 10, characterized in that the chromium content is in a range of from 10 to 40% by weight.

13. A contact material for a vacuum circuit breaker according to claim 10, characterized in that said boride of tungsten is at least one kind selected from WB and $W_2B_5$.

* * * * *